US007434927B2

(12) United States Patent
Sakuma et al.

(10) Patent No.: US 7,434,927 B2
(45) Date of Patent: Oct. 14, 2008

(54) INKJET RECORDING DEVICE

(75) Inventors: Hideomi Sakuma, Kanagawa (JP); Shinji Imoto, Tokyo (JP); Yohichi Itoh, Kanagawa (JP); Hiroshi Yasuda, Gifu (JP); Akira Ishii, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 299 days.

(21) Appl. No.: 10/534,335

(22) PCT Filed: Nov. 25, 2003

(86) PCT No.: PCT/JP03/14998

§ 371 (c)(1),
(2), (4) Date: May 10, 2005

(87) PCT Pub. No.: WO2004/048240

PCT Pub. Date: Jun. 10, 2004

(65) Prior Publication Data

US 2006/0055754 A1 Mar. 16, 2006

(30) Foreign Application Priority Data

| | | |
|---|---|---|
| Nov. 26, 2002 | (JP) | 2002-341834 |
| Nov. 26, 2002 | (JP) | 2002-342036 |
| Jan. 8, 2003 | (JP) | 2003-002390 |
| Jan. 10, 2003 | (JP) | 2003-003963 |

(51) Int. Cl.
*B41J 2/01* (2006.01)

(52) U.S. Cl. ..... 347/104; 347/101; 347/16; 347/8

(58) Field of Classification Search ..... 347/104, 347/101, 16, 8
See application file for complete search history.

(56) References Cited

U.S. PATENT DOCUMENTS

| | | | | |
|---|---|---|---|---|
| 5,133,616 | A | 7/1992 | Oyaide et al. | |
| 5,467,119 | A * | 11/1995 | Richtsmeier et al. | 347/102 |
| 5,531,436 | A | 7/1996 | Ohyama et al. | |
| 6,224,203 | B1 | 5/2001 | Wotton et al. | |
| 2002/0018097 | A1 * | 2/2002 | Kitahara et al. | 347/42 |

(Continued)

FOREIGN PATENT DOCUMENTS

EP 12388124 A1 9/2002

(Continued)

OTHER PUBLICATIONS

Nov. 28, 2007 Japanese official action in corresponding Japanese application No. 2002-341834.

(Continued)

*Primary Examiner*—Matthew Luu
*Assistant Examiner*—Henok Legesse
(74) *Attorney, Agent, or Firm*—Cooper & Dunham LLP

(57) ABSTRACT

An inkjet recording device is disclosed that is capable of precisely defining the gap between a conveyance belt and a recording head and maintaining good flatness of the conveyance belt and a recording medium being conveyed. A guide unit is arranged to push a portion of the conveyance belt from the inner side to approach the recording unit. The guide unit has a number of projecting ribs formed on the surface of the guide unit in contact with the conveyance belt and arranged to be perpendicular to the rolling direction of the conveyance belt.

19 Claims, 8 Drawing Sheets

U.S. PATENT DOCUMENTS

| | | | | |
|---|---|---|---|---|
| 2002/0021312 | A1* | 2/2002 | Matsumoto | 347/1 |
| 2003/0085978 | A1* | 5/2003 | Ishii et al. | 347/104 |

FOREIGN PATENT DOCUMENTS

| | | |
|---|---|---|
| JP | 2-182641 | 7/1990 |
| JP | 4-55245 | 2/1992 |
| JP | 5-518 | 1/1993 |
| JP | 7-53081 | 2/1995 |
| JP | 7-53082 | 2/1995 |
| JP | 7-311485 | 11/1995 |
| JP | 9-222801 | 8/1997 |
| JP | 10-193584 | 7/1998 |
| JP | 2897960 | 3/1999 |
| JP | 11-348373 | 12/1999 |
| JP | 11-349182 | 12/1999 |
| JP | 2000-143026 | 5/2000 |
| JP | 2000-158637 | 6/2000 |
| JP | 2000-211768 | 8/2000 |
| JP | 2000-272770 | 10/2000 |
| JP | 2001-262459 | 9/2001 |
| JP | 2001-287377 | 10/2001 |
| JP | 2002-103598 | 4/2002 |
| JP | 2002-145474 | 5/2002 |

OTHER PUBLICATIONS

Nov. 28, 2007 Japanese official action in corresponding Japanese application No. 2002-342036.

Dec. 5, 2007 European search report in corresponding European patent Application No. EP 03774206.

May 19, 2008 Chinese official action in connection with corresponding Chinese application No. 200301040186 (and English translation thereof).

* cited by examiner

INKJET RECORDING DEVICE

TECHNICAL FIELD

The present invention relates to an inkjet recording device, specifically, an inkjet recording device that includes a charged conveyance belt for conveying a printing sheet and a guide plate for guiding the conveyance belt.

BACKGROUND ART

An inkjet recording device is used in a printer, a facsimile, a copier, and other image forming apparatuses. The inkjet recording device ejects ink drops from an ink recording head to a recording medium to record an image. The recording medium may be, for example, a piece of paper, an OHP sheet, or in general, a printing sheet, to which the drops of ink can adhere. The inkjet recording device is capable of recording fine images at high speed, has a low running cost and low noise. Further, by using multicolor ink, it is easy for the inkjet recording device to record color images.

In an inkjet recording device of the related art, a guide plate is provided opposite to an ink recording head, and the ink recording head prints onto a printing sheet when the printing sheet is conveyed onto the guide plate. Further, a spur having a projecting peripheral portion is also provided to press the printing sheet onto the guide plate during printing. By this structure, the printing sheet is kept flat during printing.

In the inkjet recording device of the related art, feeding of a printing sheet is performed by using two groups of rollers arranged one group at each end of a printing area. With this structure, however, it is difficult to obtain high feeding precision unless the printing sheet is firmly in contact to both of the groups of rollers.

For example, Japanese Laid Open Patent Application No. 2000-211768 discloses the above inkjet recording device of the related art.

Recently, a larger printing area has become required, and in order to increase the printing area, there is proposed an inkjet image recording device having only one group of rollers for feeding the printing sheet. But this device makes it even more difficult to obtain high feeding precision. Specifically, with the printing sheet being in contact to rollers at only one side, sometimes the printing sheet floats relative to the rollers sometimes, and a force for conveying the printing sheet cannot be obtained. Consequently, the feeding precision becomes low, and the image quality declines.

Therefore, inkjet recording devices are proposed to solve this problem in which, in order to maintain flatness of the printing sheet, a charged seamless belt is provided to hold the printing sheet on the belt by an electrostatic force due to the charge, and the belt is rolled in this state to convey the printing sheet. In this way, floating of the printing sheet from the belt is preventable and good flatness can be obtained.

For example, Japanese Laid Open Patent Application No. 7-53082, Japanese Patent Publication No. 2897960, and Japanese Laid Open Patent Application No. 5-518 disclose the above inkjet recording device.

Further, as disclosed in Japanese Laid Open Patent Application No. 7-53082, a guide plate is provided on the inner side of the seamless belt at a position corresponding to the printing area to improve flatness of the printing sheet.

In the inkjet recording device in which the printing sheet is fed while being held on the feeding belt by an electrostatic force, in order to stack the printing sheet on a sheet delivery unit, the printing sheet is separated from the feeding belt by curvature separation. However, relatively soft printing sheets cannot be easily separated from the belt. These printing sheets are continuously conveyed while being held on the belt, causing jams of the printing sheets.

In addition, in the above inkjet recording device of the related art, the feeding belt is tensioned by at least two rollers and the portion of the belt between the rollers corresponds to the printing area, that is, the area printed on by the inkjet head. This portion of the belt rumples easily, and oscillates in a direction perpendicular to the belt surface when the belt is rolled, causing declination of flatness of-the belt. Since generally the flatness of the printing sheet is directly related to flatness of the belt, the distance between the recording head and the printing sheet changes, causing image quality to decline.

In addition, even when a guide plate is provided in the way as described above, it is not easy to obtain high printing precision because the distance between the recording head and the printing sheet influences the printing precision and it is difficult to make the surface of the guide plate highly flat. Further, if the guide plate touches the moving charged seamless belt, the belt may lose the charge, and this lowers the electrostatic force for holding the printing sheet.

DISCLOSURE OF THE INVENTION

Accordingly, it is a general object of the present invention to solve the above problem of the related art.

A first more specific object of the present invention is to provide an inkjet recording device and a sheet conveyance device capable of precisely defining the distance between a conveyance belt and a recording head, and maintaining good flatness of the conveyance belt and a recording medium.

A second more specific object of the present invention is to provide an inkjet recording device and a sheet conveyance device capable of reliably separating the recording medium from the conveyance belt.

According to a first aspect of the present invention, there is provided an inkjet recording device that comprises a conveyance belt tensioned on a plurality of rollers for conveying a recording medium while rolling, a recording unit configured to eject ink onto the recording medium on the conveyance belt, and a guide unit arranged on the inner side of the conveyance belt facing the recording unit between two of the rollers. The conveyance belt is charged to hold the recording medium thereon for conveyance. The guide unit is arranged to push a portion of the conveyance belt so that the pushed portion of the conveyance belt approaches the recording unit.

The guide unit may include a plurality of projecting stripes on a surface of the guide unit in contact with the conveyance belt. The projecting stripes are arranged in a direction perpendicular to a rolling direction of the conveyance belt. A width of each of the projecting stripes may be substantially less than or equal to 5 mm.

An upper face of the guide unit is higher than the upper tangent line of two of the plurality of rollers.

The inkjet recording device may further comprise a separation unit arranged on a downstream side relative to the pushed portion for separating the recording medium from the conveyance belt after recording the separation unit may include a separation claw. The separation claw may be arranged to be contactable to and separatable from a surface of the conveyance belt.

The inkjet recording device may further comprise a guide roller arranged on the inner side of and in contact with the conveyance belt at one of the ends of the guide unit along the rolling direction of the conveyance belt.

According to a second aspect of the present invention, there is provided an inkjet recording device that comprises a conveyance belt tensioned on a plurality of rollers for conveying a recording medium while rolling, a recording unit configured to eject ink onto the recording medium on the conveyance belt, a guide unit arranged on the inner side of the conveyance belt facing the recording unit between two of the rollers, and delivering rollers arranged to carry the recording medium conveyed by the conveyance belt after recording so as to further convey the recording medium. The conveyance belt is charged to hold the recording medium thereon for conveyance. The height where the delivering rollers carry the recording medium is lower than the height of an upper face of the guide unit in contact with the conveyance belt.

The inkjet recording device may further comprise a conveying roller arranged in contact with one of the rollers tensioning the conveyance belt to convey the recording medium to the recording unit. The height where the conveying roller carries the recording medium is lower than the height of the upper face of the guide unit in contact with the conveyance belt.

The height where the conveying roller carries the recording medium is higher than the height where the delivering rollers carry the recording medium.

The recording medium is inverted before being carried by the conveying roller.

According to a third aspect of the present invention, there is provided an image forming apparatus that comprises a conveyance belt tensioned on a plurality of rollers for conveying a recording medium while rolling, a recording unit configured to eject ink onto the recording medium on the conveyance belt, and a guide unit arranged on the inner side of the conveyance belt facing the recording unit between two of the rollers. The conveyance belt is charged to hold the recording medium thereon for conveyance. The guide unit is arranged to push a portion of the conveyance belt so that the pushed portion of the conveyance belt approaches the recording unit.

According to a fourth aspect of the present invention, there is provided an image forming apparatus that comprises a conveyance belt tensioned on a plurality of rollers for conveying a recording medium while rolling, a recording unit configured to eject ink onto the recording medium on the conveyance belt, and a guide unit arranged on the inner side of the conveyance belt facing the recording unit between two of the rollers, and delivering rollers arranged to carry the recording medium conveyed from the conveyance belt after recording so as to further convey the recording medium. The conveyance belt is charged to hold the recording medium thereon for conveyance. The height where the delivering rollers carry the recording medium is lower than the height of an upper face of the guide unit in contact with the conveyance belt.

The image forming apparatus may further comprise a conveying roller arranged in contact with one of the rollers tensioning the conveyance belt to convey the recording medium to the recording unit. The height where the conveying roller carries the recording medium is lower than the height of the upper face of the guide unit in contact with the conveyance belt.

According to a fifth aspect of the present invention, there is provided a sheet conveyance device that comprises a conveyance belt tensioned on a plurality of rollers for conveying a recording medium while rolling, and a guide unit arranged on the inner side of the conveyance belt between two of the rollers. The conveyance belt is charged to hold the recording medium thereon for conveyance. The guide unit is arranged to push a portion of the conveyance belt from the inner side of the conveyance belt to outside of the conveyance belt so that the pushed portion of the conveyance belt is projected.

According to a sixth aspect of the present invention, there is provided a sheet conveyance device that comprises a conveyance belt tensioned on a plurality of rollers for conveying a recording medium while rolling, a guide unit arranged on the inner side of the conveyance belt facing the recording unit between two of the rollers, and delivering rollers arranged to carry the recording medium conveyed from the conveyance belt after recording so as to further convey the recording medium. The height where the delivering rollers carry the recording medium is lower than the height of the upper face of the guide unit in contact with the conveyance belt.

The sheet conveyance device may further comprise a conveying roller arranged in contact with one of the rollers tensioning the conveyance belt to convey the recording medium to the recording unit. The height where the conveying roller carries the recording medium is lower than the height of the upper face of the guide unit in contact with the conveyance belt.

BRIEF DESCRIPTION OF THE DRAWINGS

These and other objects, features, and advantages of the present invention will become more apparent from the following detailed description of preferred embodiments given with reference to the accompanying drawings, in which.

BEST MODE FOR CARRYING OUT THE INVENTION

Below, preferred embodiments of the present invention will be explained with reference to the accompanying drawings.

First Embodiment

Figure 1:
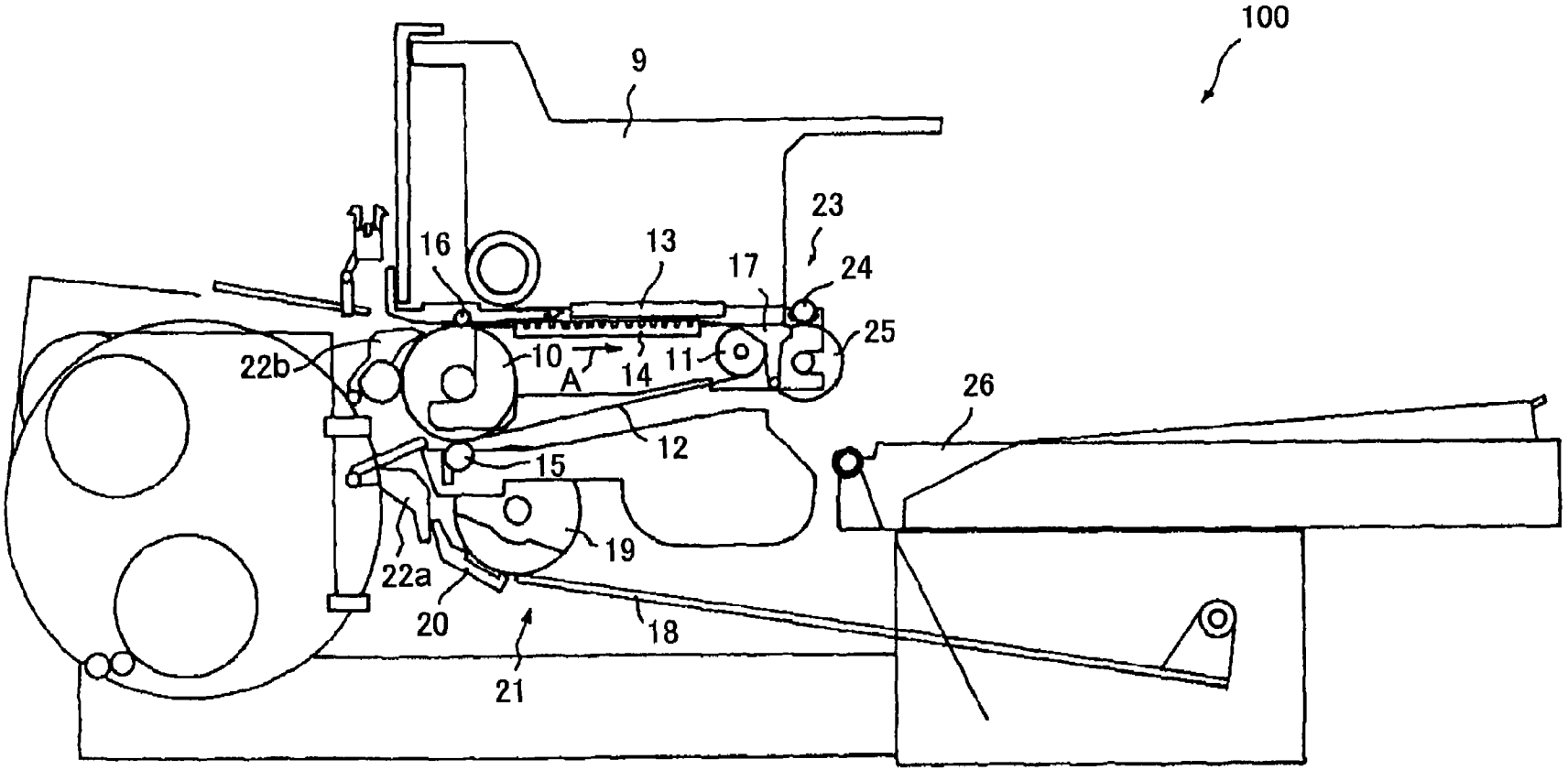
FIG. 1 is a schematic view of an inkjet printer according to a first embodiment of the present invention.

FIG. 1 is a schematic view of an inkjet printer 100 as a first embodiment of an inkjet recording device according to the present invention.

The inkjet printer 100 includes a driving roller 10, a tension roller 11, and a charged conveyance belt 12 tensioned on the rollers 10 and 11. The roller 10 is grounded. The conveyance belt 12 is a closed belt, and may be fabricated into this form directly or by connecting two ends of a belt string.

Figure 2:
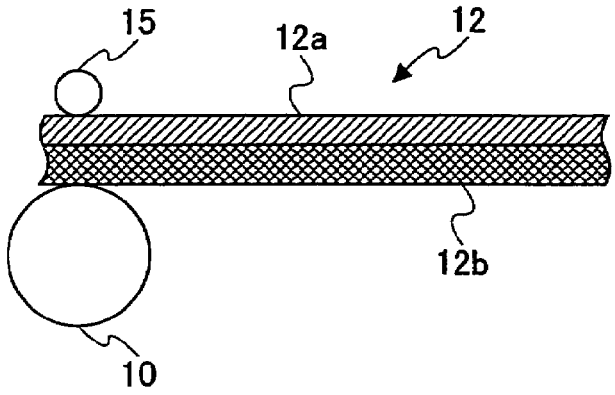
FIG. 2 is a view showing a structure of the conveyance belt in the first embodiment.

FIG. 2 is a view showing a structure of the conveyance belt 12.

As shown in FIG. 2, the conveyance belt 12 includes a front layer 12*a* and a back layer 12*b*. The front layer 12*a* is an insulating film, and formed from a pure resin without any resistance adjustment, for example, a pure ETFT material. The thickness of the front layer 12*a* is, for example, 40" m. The front layer 12*a* holds the printing sheet during conveyance. The back layer 12*b*, also called as an intermediate resistance layer, or an earth layer, is formed from the same material as that of the front layer 12*a*, and is subjected to resistance adjustment with carbon. The back layer 12*b* is in contact to the roller 10 and is grounded.

The thickness of the front layer 12*a* influences its dielectric constant. Specifically, the dielectric constant decreases when the front layer 12*a* becomes thicker, resulting a smaller amount of charge carried by the belt 12. Therefore, it is preferable to reduce the thickness as much as possible to increase the electrostatic attraction force of the belt 12 as long as fluctuation of the thickness of in fabrication is sufficiently small and the thickness does not become zero even when the belt 12 is scarred in practical use.

The thickness of the back layer 12*b* has no direct electrical effect, but if the total thickness of the belt 12 increases, the belt 12 becomes more rigid, and it becomes difficult to obtain good flatness when tensioning the belt 12 in practical use. To the contrary, ion order to maintain the required strength, the thickness of the belt 12 cannot be too small. It is experimentally found that preferable range of the thickness of the back layer 12*b* is from 50" m to 200" m.

With such a two-layer configuration and a back layer subjected to a resistance adjustment, after charge is deposited to the front layer 12*a*, when a printing sheet touches the belt 12, additional charge is supplied, and this increases the electrostatic attraction force between the belt 12 and the printing sheet. If the belt had only one insulating layer, the electrostatic attraction force would be reduced to half, and the printing sheet had to start to touch the belt 12 at the position of the earth roller 10. With the two-layer configuration, the belt 12 does not suffer from this restriction.

The driving roller 10 is driven by a driving system including a not-illustrated motor, and further drives the conveyance belt 12 to roll along the direction A (the sub scan direction).

The inkjet printer 100 also includes a recording head 13 for ejecting ink onto a printing sheet conveyed by the conveyance belt 12, and a carriage 9 that carries the recording head 13 and moves forward and backward perpendicular to the paper including FIG. 1 printed thereon, when ink is ejected from the recording head 13.

Figure 3:
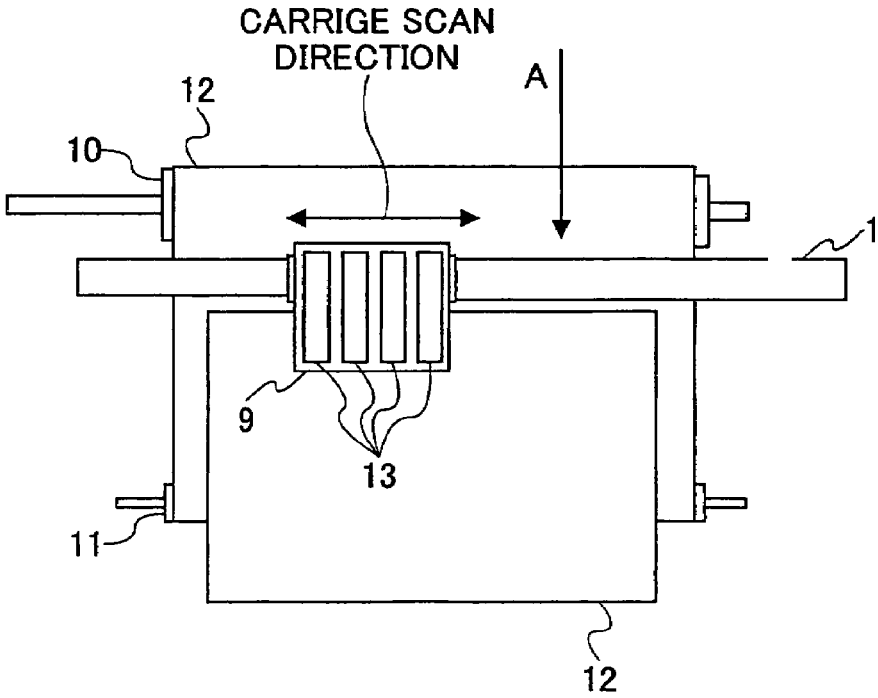
FIG. 3 is a plan view of a principal portion of the inkjet printer in the first embodiment.

FIG. 3 is a plan view of a principal portion of the inkjet printer 100.

The carriage 9 is swingably supported by a guide-rod 1 and a not-illustrated stay so that the carriage 9 can swing in the main scan direction. A not-shown main scan motor drives the carriage 9 to move along the main scan direction.

The recording head 13 includes four inkjet heads for ejecting yellow, cyan, magenta, and black ink droplets, respectively; the four inkjet heads are arranged along the main scan direction with their ejecting opening to eject ink droplets downward.

Each of the inkjet heads may include an energy-generating unit to force the ink to be ejected, such as, a piezoelectric actuator, for example a piezoelectric element, a thermal actuator employing a phase transition of a boiling liquid caused by using an thermo-electric transforming element such as a resistor, or an electrostatic actuator employing an electrostatic force.

In the carriage 9, four not-illustrated sub-tanks are installed to supply ink to the recording head 13. The sub-tanks are provided with ink from a main tank (ink carriage) through an ink supplying tube.

The inkjet printer 100 also includes a guide plate 14 for guiding the conveyance belt 12, which is arranged on the inner side of the conveyance belt 12 facing the recording head 13, between the driving roller 10 and the tension roller 11, and a charging roller 15 for adding charge to the insulating layer on the surface of the conveyance belt 12.

The charging roller 15 is arranged to be in contact with the surface of the belt 12, and revolves along with the rolling of the belt 12. When a printing sheet is conveyed to the roller 10 and an end thereof is pressed on the belt 12, a high voltage is applied to the charging roller 15 by a high voltage power supply, thereby the belt 12 is charged. The printing sheet is induced to possess charge of the negative polarity, and is attracted by the belt 12. Thus, while the belt 12 is rolling, the printing sheet is conveyed along the sub scan direction to the print area of the recording unit 13.

The carriage 9 is moved to drive the recording unit 13 according to the image signal, so as to eject ink droplets to the rest printing sheet to record one line of the object image; after the printing sheet is further conveyed by a distance equivalent to one line, the next line is recorded. When receiving a recording completion signal or a signal indicating the back end of the printing sheet enters the printing area, the recording operation is finished, and the printing sheet is delivered to a delivering tray 26 described below.

The inkjet printer 100 also includes a conveying roller 16 arranged on the upstream side of the recording head 13 along the rolling direction A of the conveyance belt 12 to press the conveyance belt 12 against the driving roller 10 so as to place a printing sheet in close contact with the conveyance belt 12, and a separation claw 17 arranged on the downstream side of the recording head 13 along the rolling direction A of the conveyance belt 12 to press the tension roller 11 with the conveyance belt 12 in between so as to separate the printing sheet from the conveyance belt 12.

The inkjet printer 100 also includes a sheet feeding tray 18 for carrying the printing sheets, and a sheet feeding roller 19 for delivering the printing sheets from the sheet feeding tray 18, and a separating pad 20 for separating one sheet from others after being delivered by the separating pad 20. The sheet feeding tray 18, the sheet feeding roller 19, and the separating pad 20 constitute a sheet feeding unit 21.

The inkjet printer 100 also includes a guide member 22*a* for guiding one sheet separated by the sheet feeding unit 21, specifically, by the separation pad 20, to convey the sheet upward in a nearly perpendicular direction, and a guide member 22*b* arranged on the upstream side of the conveying roller 16 along the rolling direction A of the conveyance belt 12 to change the moving direction of the printing sheet from the guide member 22*a* by nearly 90 degrees and to convey the printing sheet in the horizontal direction to the space between the conveyance belt 12 and the conveying roller 16.

In order to change the moving direction of the printing sheet fed perpendicularly by the guide member 22*a* by nearly 90 degrees to the horizontal direction, the surface of the guide member 22*b* facing the conveyance belt 12 is shaped to be an arc, having a radius of curvature greater than that of the conveyance belt 12, and thus forming an arc-shaped conveying path between the guide member 22*a* and the conveyance belt 12.

The inkjet printer 100 also includes a pair of rollers 23 for conveying a printing sheet separated by the separation claw 17 from the conveyance belt 12, and a delivering tray 26 for stacking the printing sheets conveyed by the pair of rollers 23.

The pair of rollers 23 includes a spur roller 24 and a roller 25 in contact with the roller 24. Although not illustrated in FIG. 1, the spur roller 24 may have a number of projections on the circumferential outside surface thereof.

Figure 7:
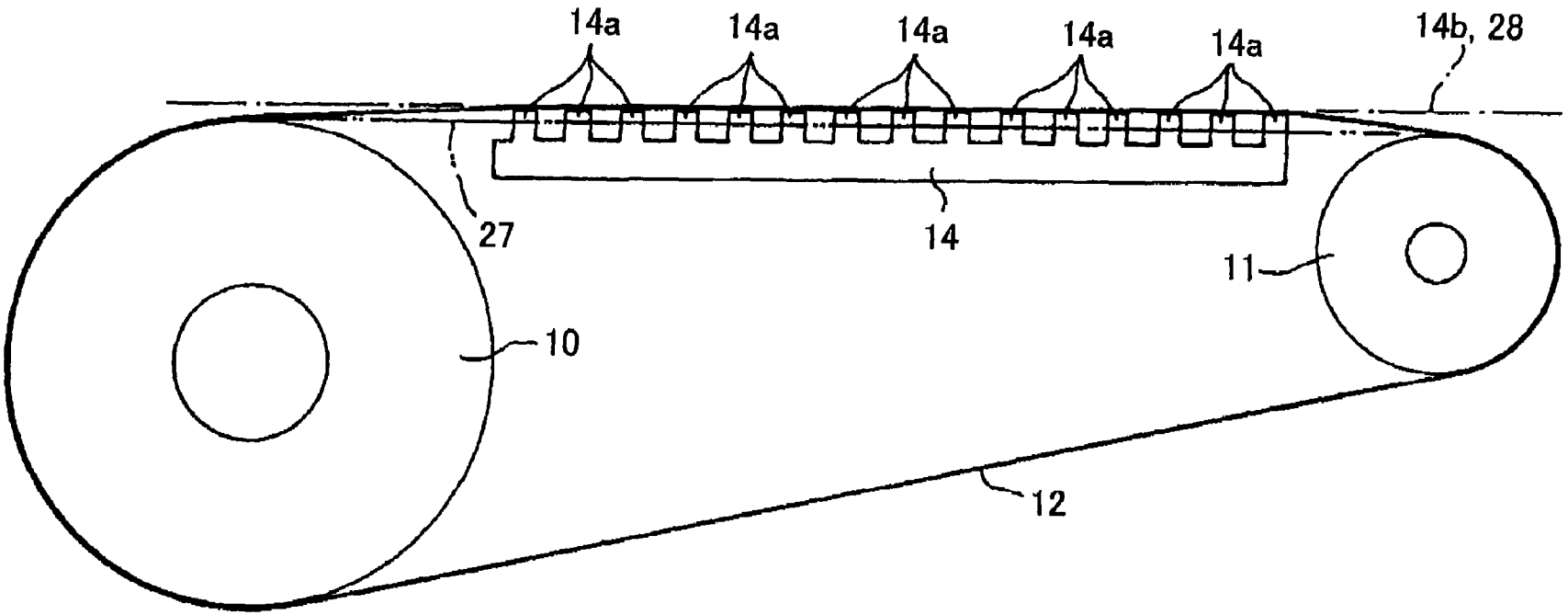
FIG. 7 is a schematic view of the sheet conveyance portion of the inkjet printer in the first embodiment.

The guide plate 14 has a size sufficient to cover the ejection area of ink from nozzles (not-illustrated) in the recording head 13, in other words, the scanning area of the carriage 9. The guide plate 14 is mounted to face the ink ejection area or the carriage scanning area and has a guide surface 14b as illustrated in FIG. 7 by a dot-dashed line. The guide plate 14 pushes the conveyance belt 12 from the inner side toward the carriage 9, forming a flat portion 28 to maintain the conveyance belt 12 and the printing sheet flat, as described below.

The guide plate 14 is formed by resin molding. Usually, it is difficult to obtain a flat and uniform surface with high precision by resin molding. Meanwhile, if the flatness of the guide plate 14 is not sufficiently good, the flatness of the conveyance belt 12 in contact with the guide plate 14 declines, and the gap between the conveyance belt 12 and the recording head 13 changes, resulting in low recording precision, and in turn low image quality. As a solution to this difficulty, a number of projecting ribs are formed on the surface of the guide plate 14 in contact with the conveyance belt 12.

Figure 4:
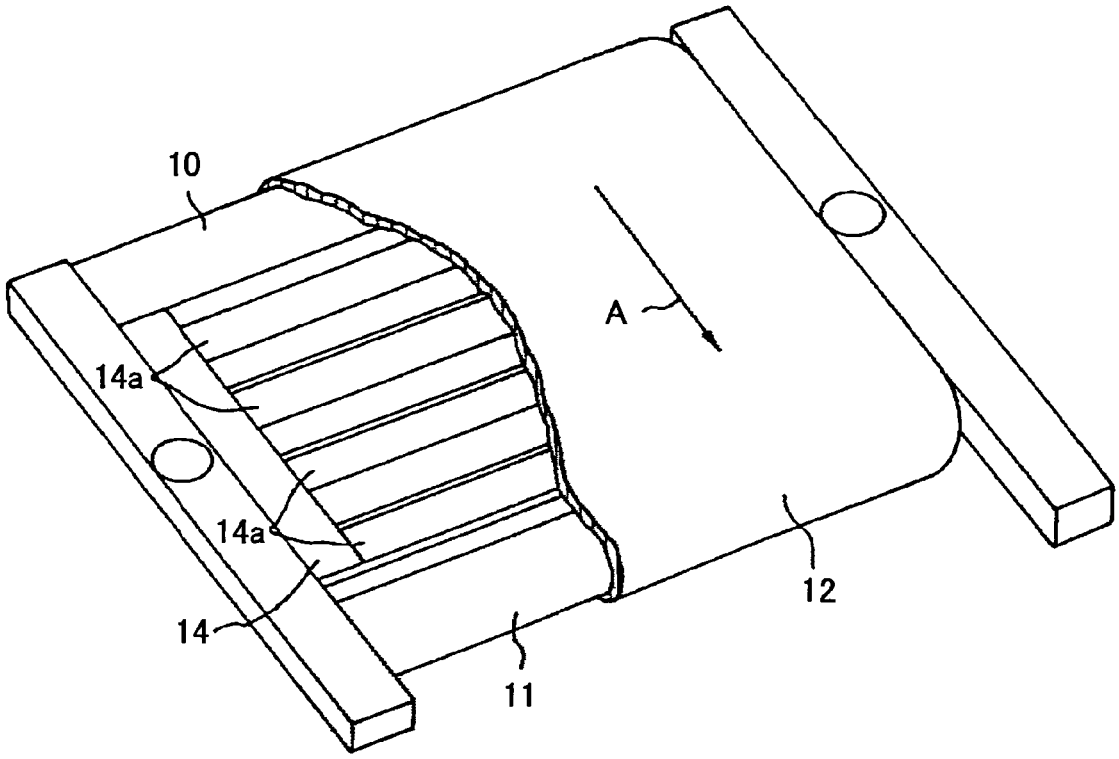
FIG. 4 is a perspective view of a sheet conveyance portion of the inkjet printer according to the first embodiment of the present invention showing the structure of the guide plate.

FIG. 4 is a perspective view of a portion of the inkjet printer 100 including the rollers 10 and 11, the conveyance belt 12 and the guide plate 14, showing the structure of the ribs on the surface of the guide plate 14.

Figure 5:
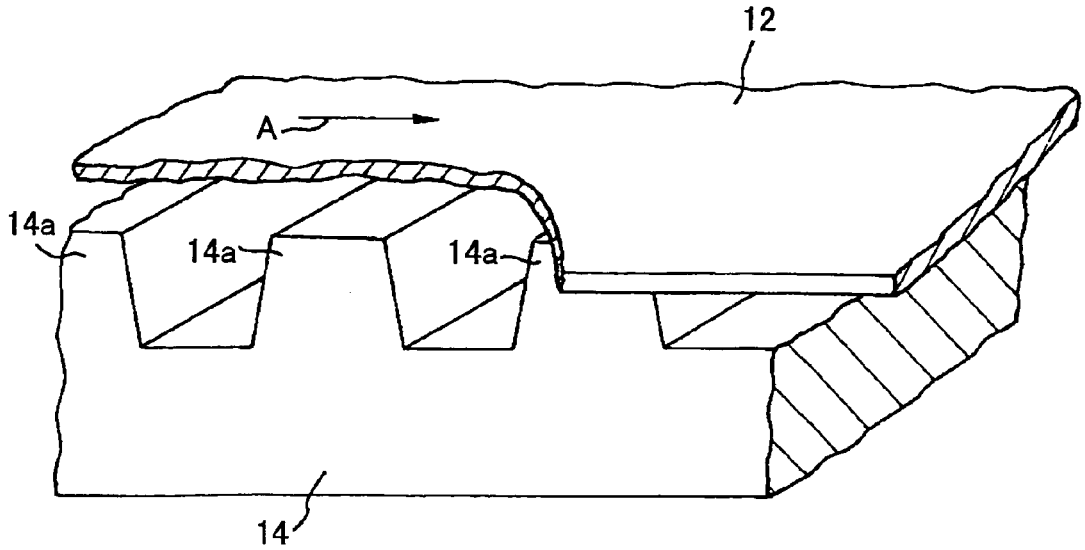
FIG. 5 is a perspective cross-sectional view of a portion of the guide plate in the first embodiment.

FIG. 5 is a perspective cross-sectional view of a portion of the guide plate 14.

Figure 6:
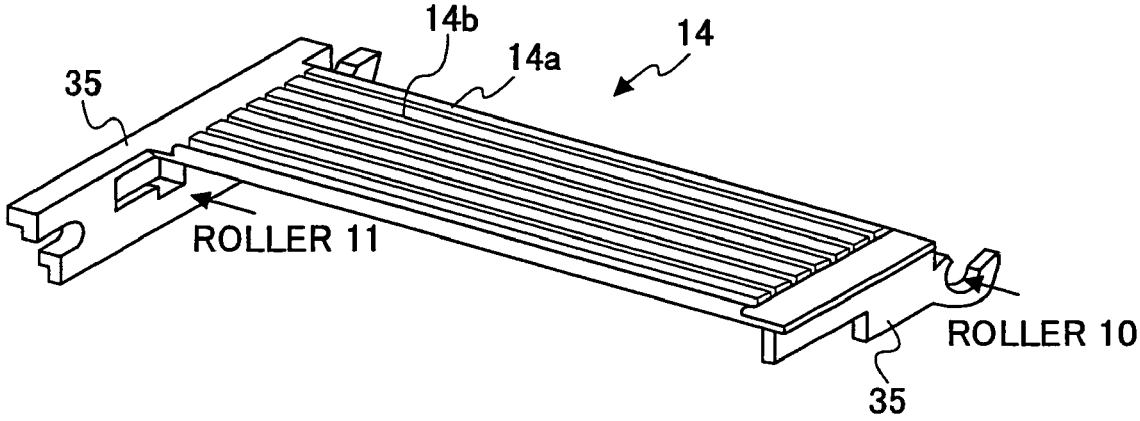
FIG. 6 is a perspective view of the guide plate in the first embodiment.

FIG. 6 is a perspective view of the guide plate 14.

As shown in FIG. 4, FIG. 5 and FIG. 6, a number of ribs 14*a* are formed parallel to each other and perpendicular to the rolling direction A of the conveyance belt 12. The top surfaces of the ribs 14*a* are in contact with the conveyance belt 12 to guide the conveyance belt 12. As shown in FIG. 6, the guide plate 14 is held by members 35*a* and 35*b* for supporting rollers 10 and 11.

FIG. 7 is a view of the portion of the inkjet printer 100 including the rollers 10 and 11, the conveyance belt 12 and the guide plate 14, showing the structure of the ribs 14*b* on the surface of the guide plate 14.

As shown by the dot-dashed line in FIG. 7, the top surfaces of the ribs 14*a* in contact with the conveyance belt 12 form a guide surface 14*b*, and the corresponding portion of the conveyance belt 12 is projected, forming a flat portion 28 parallel to the scanning surface of the recording head 13.

The width of each of the ribs 14*a* in the rolling direction A may be, for example, 5 mm.

Usually, it is easier to obtain a flat and uniform surface of a stripe, like a rib 14*a*, than a relatively large plate, like a guide plate without ribs. Thereby, sufficiently good flatness of the guide surface 14*b* is obtainable, thus the gap between the conveyance belt 12 and the recording head 13 is made constant with high precision, resulting in high recording precision and high image quality.

It should be noted that if the ribs are formed parallel to the moving direction A, because the length of each rib would be the same as that of the guide plate itself, it would be difficult to obtain precise flatness and uniformity of the top surface of the ribs, just as in the case of a guide plate without ribs.

In addition, because only the top surfaces of the ribs 14*a* are in contact with the conveyance belt 12, the contacting area between the guide plate 14 and the conveyance belt 12 is small, and the friction force between the guide plate 14 and the conveyance belt 12 is small, thus conveyance belt 12 may move on the guide plate 14 smoothly. As a result, the load of the driving system of the conveyance belt 12.can be reduced compared with the case in which the guide plate 14 does not have the ribs and the entire top surface is in contact with the conveyance belt 12.

Further, because only the top surfaces of the ribs 14*a* are in contact with the conveyance belt 12, loss of charge of the conveyance belt 12 due to contact with the guide plate is reduced, hence the conveyance belt 12 has a sufficiently large electrostatic attraction force for holding the printing sheet. As a result, the printing sheet can be kept highly flat, just as the conveyance belt 12, even when water in the ink is absorbed by the printing sheet.

From the view of the load of the driving system of the conveyance belt 12 and charge loss of the conveyance belt 12, it is preferable to set the width of each of the ribs 14*a* in the rolling direction A to be less than or equal to 5 mm.

As shown in FIG. 7, because of the arrangement of the guide plate 14, the flat portion 28 of the conveyance belt 12 formed by the guide surface 14*b* of the guide plate 14 is moved to be closer to the recording head 13 than the plane 27 formed without the guide plate 14.

If the guide surface 14*b* is not present or is not arranged to push the conveyance belt 12 as in the present embodiment, the conveyance belt 12 is supported only by the driving roller 10 and the tension roller 11, and the belt 12 oscillates like a string. As a result, the gap between the conveyance belt 12 and the recording head 13 is not constant, and the image quality declines.

With the arrangement in the present embodiment, the oscillation of the belt is preventable, and the gap between the conveyance belt 12 and the recording head 13 becomes constant, resulting in high image quality.

Because the printing sheet is held on the flat portion 28 of the conveyance belt 12 by an electrostatic force during recording, the printing sheet is maintained to be highly flat.

Second Embodiment

The inkjet recording device according to the present invention has the same configuration as the inkjet printer 100 in FIG. 1 in the first embodiment. Below, the same numeral references as those in the first embodiment are used for description.

As described in the first embodiment, the inkjet printer 100 includes a conveying roller 16 arranged on the upstream side of the recording head 13 along the rolling direction A of the conveyance belt 12 to press the conveyance belt 12 against the driving roller 10 so as to place a printing sheet in close contact with-the conveyance belt 12. The inkjet printer 100 also includes a pair of rollers 23 for conveying a printing sheet separated by the separation claw 17 from the conveyance belt 12. The pair of rollers 23 includes a spur roller 24 and a roller 25 in contact with the roller 24. The spur roller 24 may have a number of projections on the circumferential outside surface thereof.

Figure 8:
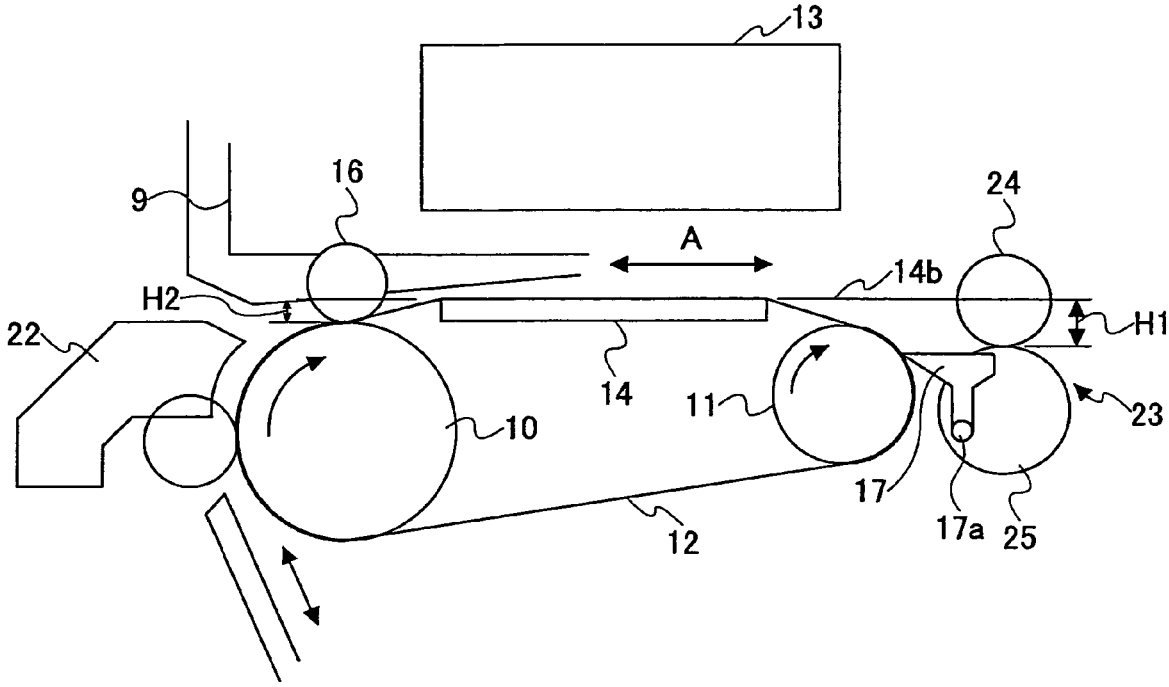
FIG. 8 is a schematic view of an example of the sheet conveyance portion of the inkjet printer in the second embodiment.

FIG. 8 is a schematic view of an example of a portion of the inkjet printer 100 including the conveyance belt 12, the conveying roller 16, and the pair of rollers 23 for conveying a printing sheet.

As shown in FIG. 8, the contacting position between the roller 16 and the roller 10, and the contacting position between the roller 24 and the roller 25 are the positions where the rollers 16 and 10, and the rollers 24 and 25, respectively, hold the printing sheet. In FIG. 8, the roller 24 and the roller 25 are arranged so that their contacting position is lower than the guide plane 14*b* and at a position of H1; because the conveyance belt 12 is pushed upward by the guide plate 14, the contacting position of the roller 16 and the roller 10 is also lower than the guide plane 14*b* and at a position of H2. In FIG. 8, H2 is less than H1.

Due to the guide member 22*a* and the guide member 22*b*, the moving direction of the printing sheet from the sheet feeding unit 21 is changed by nearly 90 degrees twice before arriving at the printing area, that is, the flat portion 28 of the conveyance belt 12.

In the printing area, the printing sheet is moved while being held by the conveyance belt 12. Because of the position difference H1 of the rollers 23, when the leading end of the printing sheet arrives at the contacting position of the roller 24 and roller 25, the printing sheet is pulled against the guide plate 14. Similarly, the printing sheet is also pulled against the guide plate 14 on the side of the roller 16. Since the printing sheet is pulled by the roller on the two sides thereof, and is thus pressed against the guide plate 14, the printing sheet is in close contact with the conveyance belt 12, and this improves surface flatness of both the conveyance belt 12 and the printing sheet, and the gap between the recording head 13 and the conveyance belt 12, which is determined by the guide plate 14, can be maintained with high precision.

In addition, even for a printing sheet susceptible to absorbing water in the ink, resulting in deformation of the printing sheet, it is possible to fix the deformation. Further, even for a soft printing sheet susceptible to bending, resulting in floating from the conveyance belt 12 or degraded adhesiveness to the conveyance belt 12, the floating can be suppressed and the adhesiveness can be improved by the pressing action of the rollers 16 and 23. Therefore, in the above cases, the gap between the recording head 13 and the conveyance belt 12 can be well defined, and this improves printing precision and image quality.

Figure 9:
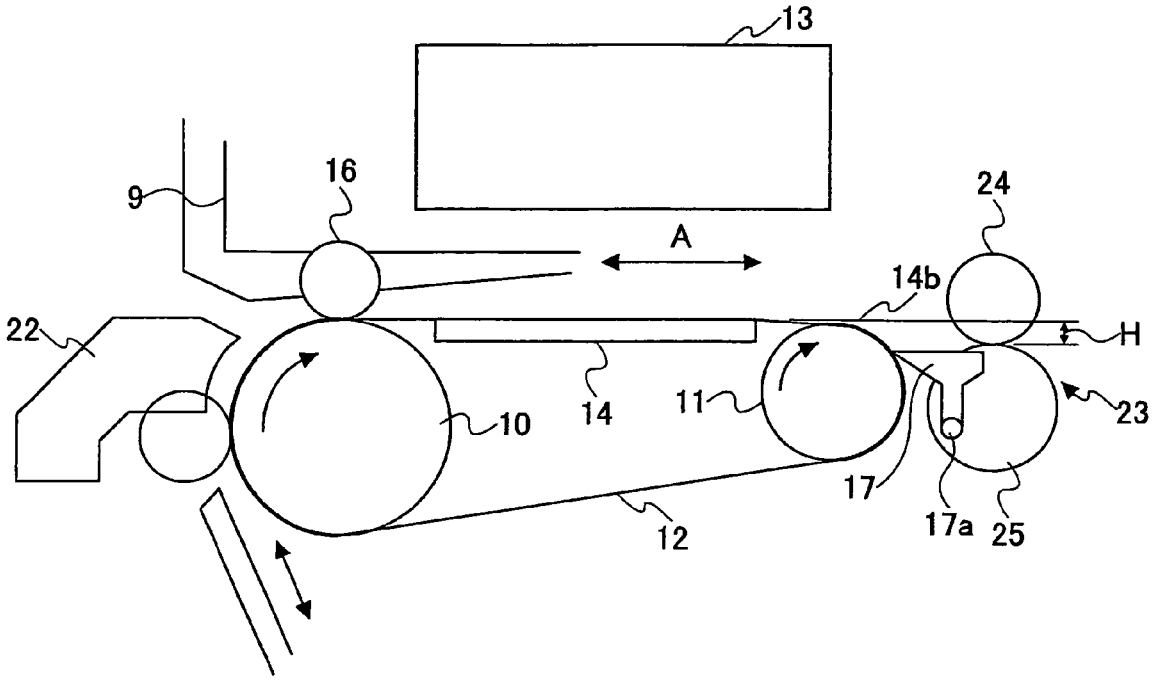
FIG. 9 is a schematic view of another example of the sheet conveyance portion of the inkjet printer in the second embodiment.

FIG. 9 is a schematic view of another example of a portion of the inkjet printer 100 including the conveyance belt 12, the conveying roller 16, and the pair of rollers 23 for conveying a printing sheet.

In FIG. 9, the guide plate 14 does not push the conveyance belt 12, hence, the guide surface 14*b*, that is, the top surface of the guide plate 14 in contact with the conveyance belt 12, is not projected, and thus the corresponding portion of the conveyance belt 12 is not projected, either.

Even in this case, the present invention is applicable. As shown in FIG. 9, the roller 24 and the roller 25 are arranged so that their contacting position, that is, the position where the rollers 24 and 25 catch the printing sheet, is lower than the guide plane 14*b* and at a position of H.

Because of the position difference H of the rollers 23, when the leading end of the printing sheet arrives at the contacting position of the roller 24 and roller 25, the printing sheet is pulled by the roller 24 and roller 25 against the guide plate 14, and the printing sheet is in close contact with the conveyance belt 12. This improves surface flatness of both the conveyance belt 12 and the printing sheet, and the gap between the recording head 13 and the conveyance belt 12 can be maintained with high precision.

In addition, even for a printing sheet susceptible to absorbing water in the ink, resulting in deformation of the printing sheet, or for a soft printing sheet susceptible to bending, resulting in floating from the conveyance belt 12 or degraded adhesiveness to the conveyance belt 12, the deformation and floating can be suppressed and the adhesiveness can be improved by the pulling action of the rollers 23. Therefore, printing precision and image quality can be improved.

Third Embodiment

The inkjet recording device according to the present invention has basically the same configuration as the inkjet printer 100 in FIG. 1 in the first embodiment. Below, only the difference with the first embodiment is explained, and the same numeral references as those in the first embodiment are used for description.

Figure 10:
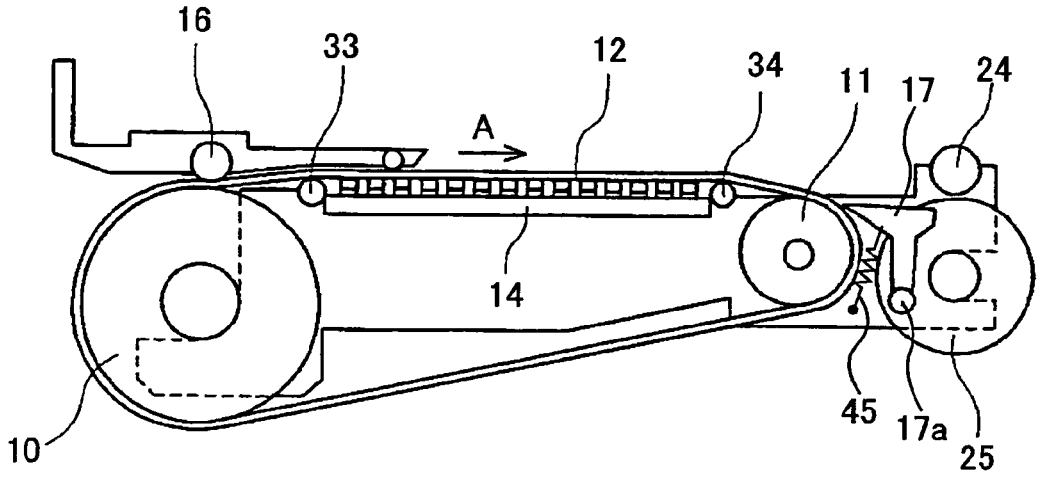
FIG. 10 is a schematic view of the sheet conveyance portion of the inkjet printer in the third embodiment.

FIG. 10 is a schematic view of the sheet conveyance portion of the inkjet printer 100.

As shown in FIG. 10, guide rollers 33 and 34 are arranged and on the inner side of the conveyance belt 12 and on the upstream side and the downstream side of the guide plate 14, respectively, along the rolling direction A of the conveyance belt 12.

The guide rollers 33 and 34 reduce the friction between the conveyance belt 12 and the guide plate 14, and thus reduce the driving load of the conveyance belt 12, and this further prevents shift of the conveyance belt 12 due to friction with the guide plate 14, and improves image quality.

In addition, as shown in FIG. 10, as a part of the delivery unit for delivering the printing sheet, a separation claw 17 is arranged in contact with the conveyance belt 12 for separating the printing sheet from the conveyance belt 12 after being recorded on by the recording head 13. The separation claw 17 is on the upstream side of the delivering rollers 24 and 25. The separation claw 17 is swingably mounted to an axle 17*a*, and is urged by a spring member 45 to touch the conveyance belt 12.

Because of the separation claw 17, the printing sheet from the conveyance belt 12 after being recorded on by the recording head 13 can be reliably separated and delivered, preventing further conveyance of the printing sheet while being held on the conveyance belt 12, and in turn, preventing jams of the printing sheets.

Figure 11:
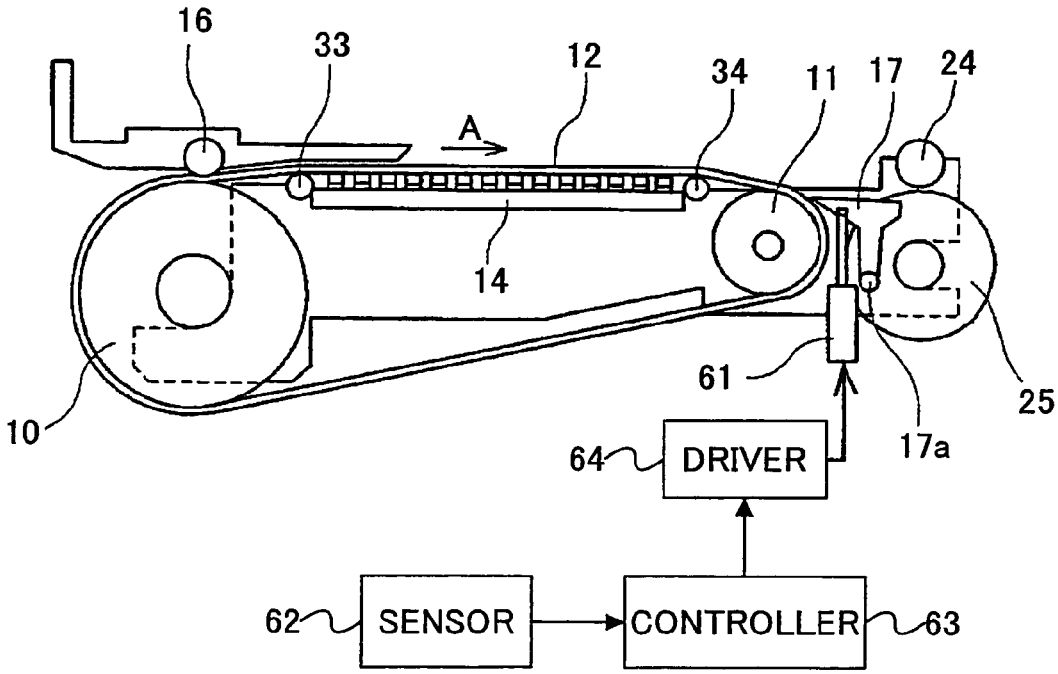
FIG. 11 is a schematic view of another example of the sheet conveyance portion of the inkjet printer in the third embodiment.

FIG. 11 shows another example of the separation claw 17 in the present embodiment.

In FIG. 11, the separation claw 17 is swingably mounted to the axle 17*a* to be contactable to and separatable from the conveyance belt 12. In addition, a plunger 61 is arranged to separate the separation claw 17 from the conveyance belt 12. In order to drive the plunger 61 to operate, a detection sensor 62 for detecting the end of a printing sheet, a main controller 63, and a driver 64 are further provided. Based on signals output by the detection sensor 62, the main controller 63 controls the plunger 61 through the driver 64.

For example, the plunger 61 may be driven to operate at the delivering timing after recording (the time required for the end of the printing sheet to reach the delivering portion). The separation claw 17 is set to be in contact with the conveyance belt 12 to separate the printing sheet from the conveyance belt 12. After the separation, the plunger 61 is stopped, and the separation claw 17 is separated from the conveyance belt 12.

Therefore, the conveyance belt 12 is set to touch the conveyance belt 12 only when necessary, and the conveyance belt 12 may last longer.

Instead of the separation claw 17, an air separation unit, which uses air flow to separate the printing sheet, may also be used.

While the present invention has been described with reference to specific embodiments chosen for purpose of illustration, it should be apparent that the invention is not limited to these embodiments, but numerous modifications could be made thereto by those skilled in the art without departing from the basic concept and scope of the invention.

The present invention is applicable to not only an inkjet printer, but also a facsimile, a copier, and other image forming apparatuses.

In addition, the number of the rollers tensioning the conveyance belt may be greater than two, and in this case, it is sufficient to consider the two rollers on the two sides of the guide plate.

Summarizing the effect of the invention, because the guide unit is arranged to push the conveyance belt, a flat portion closer to the recording unit in the printing area is formed. This prevents the oscillation of the conveyance belt, reduces the change of the distance between the conveyance belt and the recording unit, and improves printing precision and image quality.

Because the guide unit has projecting stripes formed on the surface thereof in contact with the conveyance belt, and the projecting stripes are arranged to be perpendicular to the rolling direction of the conveyance belt, it is possible to improve the precision of flatness of the surface of the guide unit and thus that of the conveyance belt and the recording medium held on the belt by an electrostatic force. This further reduces the change of the distance between the conveyance belt and the recording unit, the charge loss from the conveyance belt due to contact with the guide unit, and the load of the driving system of the conveyance belt.

Because the guide unit pushes the conveyance belt upward and the delivering rollers are lower than the pushed portion, the recording medium is pressed against the guide unit on both sides thereof, making the recording medium be in close contact with the conveyance belt, and this improves surface flatness of both the conveyance belt and the recording medium, so the distance between the recording unit and the conveyance belt can be maintained a constant. Further, even for a recording medium susceptible to absorbing water in the ink, or a soft recording medium susceptible to bending, deformation of the recording medium and floating of the recording medium can be suppressed, the adhesiveness of the recording medium to the conveyance belt can be improved, and the distance between the recording unit and the conveyance belt can be well defined. As a result, image quality can be improved.

This patent application is based on Japanese Priority Patent Application No. 2002-341834 filed on Nov. 26, 2002, Japanese Priority Patent Application No. 2002-342036 filed on Nov. 26, 2002, Japanese Priority Patent Application No. 2003-002390 filed on Jan. 8, 2003, and Japanese Priority Patent Application No. 2003-003963 filed on Jan. 10, 2003, the entire contents of which are hereby incorporated by reference.

The invention claimed is:

1. An inkjet recording device, comprising:

a conveyance belt tensioned on a plurality of rollers for conveying a recording medium while rolling, said conveyance belt being charged to hold the recording medium thereon for conveyance;

a recording unit configured to eject ink onto the recording medium on the conveyance belt; and a guide unit arranged on the inner side of the conveyance belt facing the recording unit between two of the rollers, wherein said guide unit includes a plurality of projecting stripes in contact with the conveyance belt, a top surface of said projecting stripes forming a guide surface, said projecting stripes are arranged in a direction perpendicular to a rolling direction of the conveyance belt, and said guide surface comprising the top surfaces of said projecting stripes pushes a portion of the conveyance belt corresponding to said guide surface so that die pushed portion of the conveyance belt approaches the recording unit, the recording unit covers a part of the projecting stripes of the guide unit, and the projecting swipes of the guide unit are arranged on an upstream side in a direction of conveying the recording medium relative to a position facing the recording unit.

2. The inkjet recording device as claimed in claim 1, wherein an upper face of said guide unit is higher than the upper tangent line of two of the plurality of rollers.

3. The inkjet recording device as claimed in claim 1. wherein a width of each of the projecting stripes is substantially less than or equal to 5 mm.

4. The inkjet recording device as claimed in claim 1, further comprising:

a separation unit arranged on a downstream side relative to the pushed portion for separating the recording medium from the conveyance belt after recording.

5. The inkjet recording device as claimed in claim 1, further comprising:

a guide roller arranged on the inner side of and in contact with the conveyance belt at one of the ends of the guide unit along the rolling direction of the conveyance belt.

6. The inkjet recording device as claimed in claim 1, further comprising:

a pressing unit arranged on the upstream side of the recording unit along the direction of conveying the recording medium, and configured to press the conveyance belt.

7. The inkjet recording device as claimed in claim 1, wherein said upstream side of the recording unit is away from a recording region at said position facing the recording unit.

8. The inkjet recording device as claimed in claim 4, wherein the separation unit includes a separation claw.

9. The inkjet recording device as claimed in claim 8, wherein the separation claw is arranged to be contactable to and separatable from a surface of the conveyance belt.

10. An inkjet recording device, comprising:

a conveyance belt tensioned on a plurality of rollers for conveying a recording medium while rolling, said conveyance belt being charged to hold the recording medium thereon for conveyance;

a recording unit configured to eject ink onto the recording medium on the conveyance belt;

a guide unit arranged on the inner side of the conveyance belt facing the recording unit between two of the rollers; and delivering rollers arranged to carry the recording medium conveyed by the conveyance belt after recording so as to further convey the recording medium, a height where said delivering rollers carry the recording medium being lower than the height of an upper face of said guide unit in contact with the conveyance belt, wherein said guide unit includes a plurality of projecting stripes in contact with the conveyance belt, a top surface of said projecting stripes fanning a guide surface, said projecting stripes are arranged in a direction perpendicular to a railing direction of the conveyance belt, and said guide surface comprising the top surfaces of said projecting stripes pushes a pardon of the conveyance belt corresponding to said guide surface so that the pushed portion of the conveyance belt approaches the recording unit, the recording unit covers a part of the projecting stripes of the guide unit, and the projecting stripes of the guide unit are arranged on an upstream side in a direction of conveying the recording medium relative to a position facing the recording unit.

11. The inkjet recording device as claimed in claim 10, further comprising:

a conveying roller arranged in contact with one of the rollers tensioning the conveyance belt to convey the recording medium to the recording unit, a height where said conveying roller carries the recording medium being lower than the height of the upper face of said guide unit in contact with the conveyance belt.

12. The inkjet recording device as claimed in claim 11, wherein the height where said conveying roller carries the recording medium is higher than the height where said delivering rollers carry the recording medium.

13. The inkjet recording device as claimed in claim 12, wherein the recording medium is inverted before being carried by the conveying roller.

14. An image forming apparatus, comprising:

a conveyance belt tensioned on a plurality of rollers for conveying a recording medium while rolling, said conveyance belt being charged to hold the recording medium thereon for conveyance;

a recording unit configured to eject ink onto the recording medium on the conveyance belt; and a guide unit arranged on the inner side of the conveyance belt facing the recording unit between two of the rollers, wherein said guide unit includes a plurality of projecting stripes in contact with the conveyance belt, a top surface of said projecting stripes forming a guide surface, said projecting stripes are arranged in a direction perpendicular to a rolling direction of the conveyance belt, and said guide surface comprising the top surfaces of said projecting strips pushes a portion of the conveyance belt corresponding to said guide surface so that the pushed portion of the conveyance belt approaches the recording unit, the recording unit covers a part of the projecting stripes of the guide unit, and the projecting stripes of the guide unit are arranged on an upstream side in a direction of conveying the recording medium relative to a position facing the recording unit.

15. An image forming apparatus, comprising:

a conveyance belt tensioned on a plurality of rollers for conveying a recording medium while rolling, said conveyance belt being charged to hold the recording medium thereon for conveyance:

a recording unit configured to eject ink onto the recording medium on the conveyance belt;

a guide unit arranged on the inner side of the conveyance belt facing the recording unit between two of the rollers; and delivering rollers arranged to carry the recording medium conveyed from the conveyance belt after recording so as to further convey the recording medium, a height where said delivering rollers carry the recording medium being lower than the height of an upper face of said guide unit in contact with the conveyance belt, wherein said guide unit includes a plurality of projecting stripes in contact with the conveyance belt, a top surface of said projecting stripes forming a guide surface, said projecting stripes are arranged in a direction perpendicular to a rolling direction of the conveyance belt, and said guide surface comprising the top surfaces of said projecting stripes pushes a portion of the conveyance belt corresponding to said guide surface so tat the pushed portion of the conveyance belt approaches the recording unit, the recording unit covers a pan of the projecting stripes of the guide unit, and the projecting stripes of the guide unit are arranged on an upstream side in a direction of conveying the recording medium relative to a position facing the recording unit.

16. The image forming apparatus as claimed in claim 15, further comprising:

a conveying roller arranged in contact with one of the rollers tensioning the conveyance belt to convey the recording medium to the recording unit, a height where said conveying roller carries the recording medium being lower than the height of the upper face of said guide unit in contact with the conveyance belt.

17. A sheet conveyance device configured to convey a recording medium to a recording unit for ejecting ink onto the recording medium, comprising:

a conveyance belt tensioned on a plurality of rollers for conveying a recording medium while rolling, said conveyance belt being charged to hold the recording medium thereon for conveyance; and a guide unit arranged on the inner side of the conveyance belt between two of the rollers, wherein said guide unit includes a plurality of projecting stripes in contact with the conveyance belt, a top surface of said projecting stripes forming a guide surface, said projecting stripes are arranged in a direction perpendicular to a rolling direction of the conveyance belt, and said guide surface comprising the top surfaces of said projecting stripes pushes a portion of the conveyance belt corresponding to said guide surface from the inner side of the conveyance belt to outside of the conveyance belt so that the pushed portion of the conveyance belt is projected, the recording unit covers a part of the projecting stripes of the guide unit, and the projecting stripes of the guide unit are arranged on an upstream side in a direction of conveying the recording medium relative to a position facing the recording unit.

18. A sheet conveyance device configured to convey a recording medium to a recording unit for ejecting ink onto the recording medium, comprising:

a conveyance belt tensioned on a plurality of rollers for conveying a recording medium while rolling, said conveyance belt being charged to hold the recording medium thereon for conveyance;

a guide unit arranged on the inner side of the conveyance belt facing the recording unit between two of the rollers; and delivering rollers arranged to carry the recording medium conveyed from the conveyance belt after recording so as to further convey the recording medium, a height where said delivering rollers carry the recording medium being lower than the height of the upper face of said guide unit in contact with the conveyance belt, wherein said guide unit includes a plurality of projecting stripes in contact with the conveyance belt, a top surface of said projecting stripes fainting a guide surface; and said projecting stripes are arranged in a direction perpendicular to a rolling direction of the conveyance belt, and said guide surface comprising the top surfaces of said projecting stripes pushes a portion of the conveyance belt corresponding to said guide surface so that the pushed portion of the conveyance belt approaches the recording unit.

19. The sheet conveyance device as claimed in claim 18, further comprising:

a conveying roller arranged in contact with one of the rollers tensioning the conveyance belt to convey the recording medium to the recording unit, a height where said conveying roller carries the recording medium being lower than the height of the upper face of said guide unit in contact with the conveyance belt.

* * * * *